US008770555B2

(12) United States Patent
Schulze et al.

(10) Patent No.: US 8,770,555 B2
(45) Date of Patent: Jul. 8, 2014

(54) METHOD AND DEVICE FOR TREATING CHARGED HOT GAS

(75) Inventors: Olaf Schulze, Tuttendorf (DE); Anton Althapp, Oberschöna (DE); Burkhard Möller, Kleinwaltersdorf (DE); Michael Gätke, Freiberg (DE); Reinhold Grunwald, Hoyerswerda (DE); Günter Scholz, Hoyerswerda (DE); Wolfgang Rabe, Bernsdorf (DE)

(73) Assignee: CCG Energy Technology Company Ltd., Tsimshatsui, Kowloon, HongKong (CH)

( * ) Notice: Subject to any disclaimer, the term of this patent is extended or adjusted under 35 U.S.C. 154(b) by 1089 days.

(21) Appl. No.: 12/676,682

(22) PCT Filed: Aug. 13, 2008

(86) PCT No.: PCT/EP2008/006651

§ 371 (c)(1),
(2), (4) Date: Oct. 26, 2010

(87) PCT Pub. No.: WO2009/033543

PCT Pub. Date: Mar. 19, 2009

(65) Prior Publication Data

US 2011/0049256 A1 Mar. 3, 2011

(30) Foreign Application Priority Data

Sep. 7, 2007 (DE) ..... 10 2007 042 543

(51) Int. Cl.
*B01F 3/04* (2006.01)

(52) U.S. Cl.
USPC ... 261/78.2; 261/112.1; 261/118; 261/DIG. 9

(58) Field of Classification Search
USPC ..... 261/78.2, 112.1, 115, 118, DIG. 9
See application file for complete search history.

(56) References Cited

U.S. PATENT DOCUMENTS

| | | | | | |
|---|---|---|---|---|---|
| 3,353,803 | A | * | 11/1967 | Wechselblatt et al. | 261/116 |
| 3,414,247 | A | * | 12/1968 | Sama | 261/118 |
| 3,593,968 | A | * | 7/1971 | Geddes | 261/118 |
| 3,638,925 | A | * | 2/1972 | Braemer | 261/6 |
| 3,737,106 | A | * | 6/1973 | Arnold et al. | 239/518 |
| 3,750,375 | A | * | 8/1973 | Wintrell | 96/245 |
| 3,959,420 | A | * | 5/1976 | Geddes et al. | 261/112.1 |

(Continued)

FOREIGN PATENT DOCUMENTS

| | | |
|---|---|---|
| DE | 26 60 512 B2 | 5/1978 |
| DE | 145 860 | 1/1981 |

(Continued)

OTHER PUBLICATIONS

English translation of International Preliminary Report on Patentability, International application No. PCT/EP2008/006651, Jun. 28, 2010, 8 pgs.

*Primary Examiner* — Charles Bushey
(74) *Attorney, Agent, or Firm* — Paul D. Strain, Esq.; Strain & Strain PLLC

(57) ABSTRACT

The invention relates to a process and a device for the treatment of charged hot gas, in particular hot pressure gasification gases from fly stream gasifiers during the partial oxidation of dust-type and/or liquid ash-containing feed in the fly stream.

21 Claims, 2 Drawing Sheets

(56) References Cited

U.S. PATENT DOCUMENTS

Figure 1:
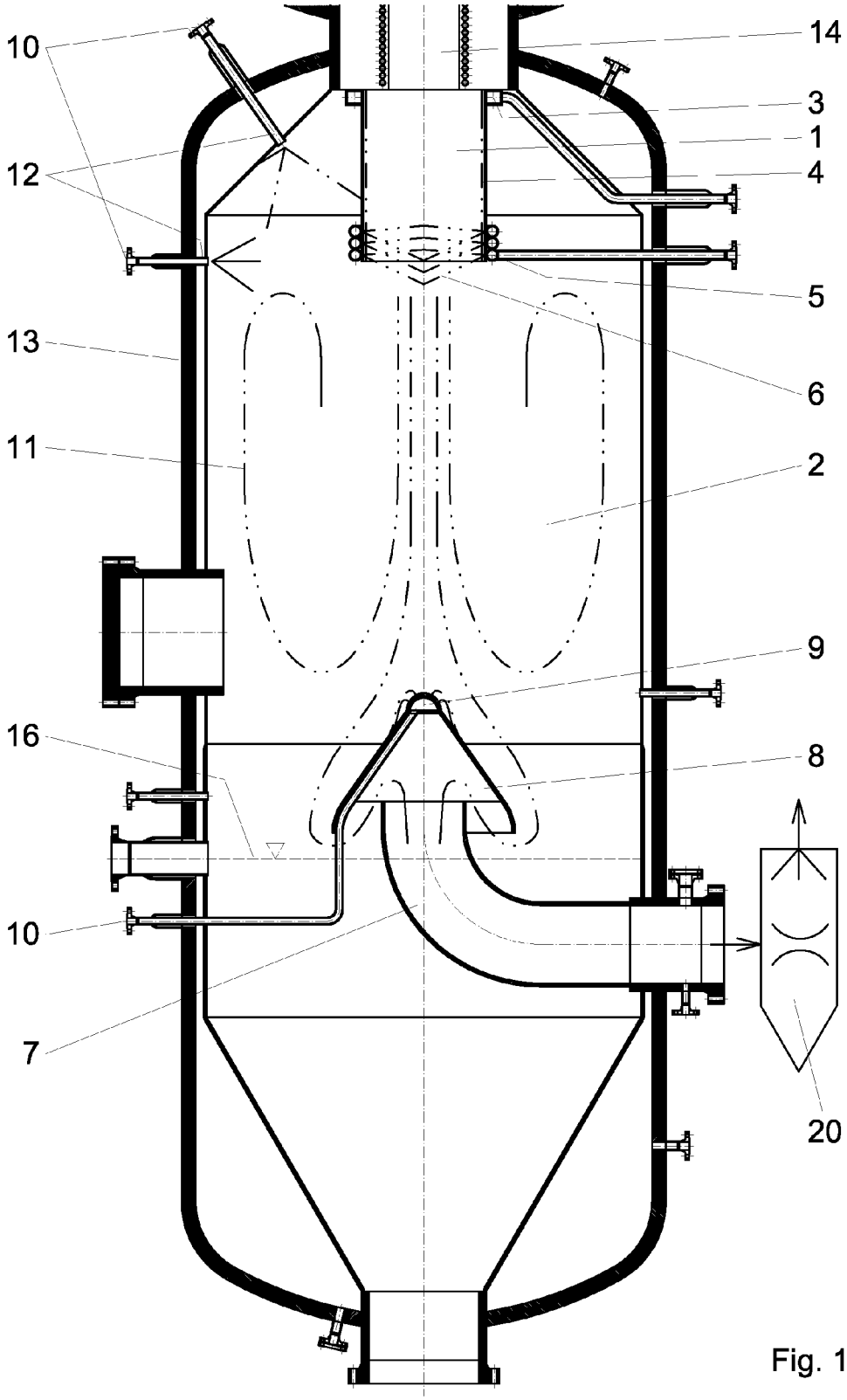

| | | | | |
|---|---|---|---|---|
| 4,144,041 | A * | 3/1979 | Hou | 96/261 |
| 4,466,808 | A | 8/1984 | Koog | |
| 4,474,584 | A | 10/1984 | Koog | |
| 4,605,423 | A | 8/1986 | Koog | |
| 4,614,229 | A * | 9/1986 | Oldweiler | 165/115 |
| 4,848,982 | A | 7/1989 | Tolle et al. | |
| 5,061,408 | A * | 10/1991 | Huning et al. | 261/112.1 |
| 5,976,203 | A | 11/1999 | Deeke et al. | |
| 6,517,770 | B1 * | 2/2003 | Tateishi et al. | 266/46 |
| 7,985,379 | B2 * | 7/2011 | Chiu et al. | 422/168 |
| 2004/0207102 | A1 * | 10/2004 | Sugimori et al. | 261/112.1 |
| 2007/0051043 | A1 | 3/2007 | Schingnitz et al. | |
| 2008/0005966 | A1 | 1/2008 | Fischer et al. | |

FOREIGN PATENT DOCUMENTS

| | | | |
|---|---|---|---|
| DE | 31 51 483 | C1 | 7/1983 |
| DE | 25 56 370 | C3 | 7/1988 |
| DE | 299 893 | A7 | 5/1992 |
| DE | 280 975 | B3 | 3/1993 |
| DE | 10 2005 041 930 | A1 | 3/2007 |
| DE | 10 2005 042 640 | A1 | 3/2007 |
| DE | 20 2007 011 055 | U1 | 12/2007 |
| DE | 10 2006 031 816 | A1 | 1/2008 |
| DE | 10 2007 006 984 | A1 | 8/2008 |
| DE | 10 2007 006 988 | A1 | 8/2008 |
| EP | 0 127 878 | B1 | 12/1984 |
| EP | 0 284 762 | B1 | 10/1988 |
| EP | 0 342 767 | B1 | 11/1989 |
| EP | 0 870 818 | A2 | 10/1998 |

* cited by examiner

METHOD AND DEVICE FOR TREATING CHARGED HOT GAS

The invention relates to a process and a device for treating charged hot gas, preferably in connection with the production of gases containing CO and $H_2$, by the partial oxidation of essentially dust-type and/or liquid feed, in particular ash-containing feed in the fly stream, the charged hot gas, in particular containing slag and solids, being conveyed from a reaction chamber into a connected cooling/quenching vessel, solids and gas being separated and a gas discharge taking place from the cooling/quenching vessel. The invention also relates to the use the device according to the invention.

For discharging a hot gas charged with liquid slag from a reaction chamber into a cooling chamber underneath, it is suggested in DD 145860, DD 299 893, EP 127878 and DE 3151483 to introduce this charged stream of gas directly into a water bath via a cooled immersion tube. This operating principle has not proved successful in practice since only short problem-free operating times are achieved and the repair and maintenance effort is considerable.

In patent application publications DE 2556370 and DE 2650512 it is suggested to spray a stream of hot gas with spray tubes. However, this application leads to deposit build-ups by the slag and to high thermal stresses exerted on the material and requires a very high level of technical-economic expenditure.

In addition, a process is known from DD 280975 in which, making use of the spray quenching, cooling water is sprayed into a stream of gas via coronae of nozzles arranged above each other with radial components and via coaxial components to the stream of gas in order to achieve steam saturation and portions of solids to be washed out. The operating times of a few weeks achieved with these devices/processes and the great cleaning effort required do not correspond to the requirements of an economic operation.

From the state of the art it is further known to cool hot streams of gas charged with liquid slag and solids, following partial direct cooling with recycled synthesis gas, as described in EP 89 201 293.1 or by partial quenching from 1200 to 1900° C. to a temperature level of 700 to 1100° C., as suggested in DE 10 2005 042 640 A1 and to subsequently cool them further indirectly with cooling batteries to 150 to 400° C. with simultaneous production of steam. Although it is possible to achieve high overall degrees of effectiveness by means of these processes at the beginning of the operating period, they have, apart from high investment costs, the further disadvantage that the availability of the gasification facility is reduced by deposits of ash and soot and the maintenance effort is increased and the advantages of additional steam production are thus largely more than compensated by the arising disadvantages.

It was consequently the object of the invention to provide a process and a device for treating charged hot gas by means of which conveying charged hot gas from a reaction chamber into a connected cooling chamber takes place in such a way that the separation of solids and gas and the gas discharge from the cooling/quenching vessel is possible with long lifetimes and a low cleaning effort and with an uncomplicated design simple to manufacture.

Charged hot gas according to the meaning of the present invention should be understood to mean a hot gas which contains components which pass into the fluid to solid state on cooling. Non-concluding examples of charged hot gasses are gases containing slag and solids which gases are obtained during the production of gases containing CO and $H_2$, by the partial oxidation of essentially dust-type and/or liquid feed, in particular ash-containing feed in the fly stream.

The device according to the invention exhibits a cooling and/or quenching vessel with a gas inlet and a gas discharge, in which vessel essentially a first quenching chamber (flash quenching chamber or pre-quenching chamber) and a second quenching chamber (main quenching chamber) are formed and which may preferably be arranged directly on the slag gas outlet from the lower part of a gasification reactor. In the upper part, in the area of the gas inlet of the cooling and/or quenching vessel, the separate flash quenching chamber is formed which is preferably essentially cylinder-shaped, in which chamber pre-quenching takes place and whose diameter is approximately 1.05 to 5 times that of the inside diameter and whose length (in the direction of flow of the hot gas) is approximately 0.5 to 5 times that of the inside diameter of the inlet for the charged hot gas. The inlet for the charged hot gas herein is preferably the gas-slag outlet of the reaction chamber of a gasification reactor, the gas flowing appropriately vertically downwards into the device. The flash quenching chamber is advantageously provided with a film production device as a result of which its inside wall is protected by a film, in particular of quenching liquid, preferably by a water film, against heat and encrustation. The water film is produced by means of the water film production device preferably at the upper edge of the flash quenching chamber and leaves the flash quenching chamber at the lower edge thereof, the water dripping off being transported into the gas chamber of the main quenching chamber which, advantageously, is filled with water in the lower part. In the lower area, practically in the lower third of the flash quenching chamber, one or several nozzle rings are arranged which are designed in such a way that up to approximately 30 nozzles, preferably 1 to 30 nozzles per 10,000 $m^3$ in the standard state, dry (i.s.dr.) of crude gas (hot gas) are available. Preferably, each nozzle ring has at least 4 individual nozzles. The beam direction of the nozzle is directed onto the axis of the charged hot gas stream (crude gas slag stream) at an angle to the horizontal downwards of preferably of −5 to 30 degrees.

By means of these nozzles, the hot stream of crude gas charged with slag particles is loaded with a quantity of quenching liquid, in particular a quantity of water of up to approximately 50 $m^3$, preferably 5 to 50 $m^3$ per 10,000 $m^3$ of crude gas in the standard state, dry, and with a nozzle discharge rate of up to approximately 30 m/s, preferably 2 to 30 m/s, the droplet spectrum being adjustable by a corresponding nozzle design within the range of up to approximately 3,000 μm, preferably 100-3,000 μm.

The external boundary of the flash quenching room may be both cylindrical and of truncated cone form with a larger diameter at the bottom edge.

The device according to the invention is equipped with at least one crude gas outlet (outlet for quenched hot gas) in the lower area of the cooling and/or quenching vessel.

In the course of investigations it was found that the teaching according to the invention results in abrupt cooling of the crude gas slag stream without negative consequences for the slag drainage and with optimum conditions for the subsequent separation of the solid particles from the crude gas.

In a preferred embodiment, the device according to the invention is equipped with at least one nozzle ring situated behind and/or below the flash quenching chamber in order to additionally further treat the secondary vortex in the upper part of the quenching chamber. The additional nozzle ring is designed in such a way that preferably treatment of 1 to 10 m/s is possible with a quantity of quenching liquid, preferably a quantity of water, of up to approximately 10 $m^3$, preferably 1 to 10 $m^3$ per 1000 $m^3$ crude gas in the standard state, dry and a nozzle discharge rate of up to approx. 30 m/s. Preferably each additional nozzle ring has at least 4 individual nozzles. The nozzles are designed in such a way that the droplet spectrum of the quenching liquid issuing from the nozzles is in the region of up to approximately 500 μm, preferably 50-500 μm. As a result of the additional nozzle ring, the inner surface of the cooling and quenching vessel is, appropriately, completely covered with a (water) film.

Advantageously, the device according to the invention exhibits a crude gas exit arranged essentially in the axis of the main quenching chamber which exit is preferably equipped with a conical gas outlet device with its conus tip directed upwards, for the separation of the solid and liquid particles. Herewith it is achieved that the main part of the solid and liquid particles is separated by deflection at the water surface into the lower part of the main quenching chamber which is advantageously continually filled with quenching liquid, preferably water, and that, as a result, a concentric secondary vortex is formed around the gas stream leaving the reactor and directed downwards and that optimum conditions for intense contact between the solid particles and the quenching liquid arise which are indispensable for gas purification.

The upper part of the conical gas outlet device is preferably equipped with a spray device such that a closed (water) film is formed on its surface and larger solids particles not yet fully cooled, in particular slag particles, are transferred into the solid state and the quenching liquid, preferably water, leaves the conical gas outlet device at its lower edge with the slag particles and thus reaches the quenching liquid collecting chamber in the lower part (lower area) of the main quenching vessel.

In a further preferred embodiment, the device according to the invention comprises as an alternative to the above-mentioned conical gas outlet device with a central crude gas exit, at least one crude gas discharge arranged essentially horizontally to the external jacket and above the surface of the liquid of the quenching liquid collecting chamber of the main quenching vessel, preferably 2 to 5 individual crude gas discharges. The at least one crude gas discharge and/or each of the individual crude gas discharges is appropriately equipped in the main quenching chamber with flow baffles arranged above the corresponding gas exit, which baffles guarantee that the rate of flow of the crude gas flowing into the individual crude gas exit is the same on leaving the main quenching chamber. The flow baffles are preferably conical segments which are fixed by their upper end on the outer jacket of the main quenching chamber and arranged inclined downwards in such a way that the streamlines of the gas stream always have the same length from the lower deflection edge of the baffle concerned up to the middle of the individual gas exit such that, as a result, a rotation-symmetrical gas conduction is guaranteed in the main quenching room.

Advantageously, the crude gas exits arranged laterally are equipped with devices which guarantee charging in the direction of flow with quenching liquid, preferably water, such that the discharging pipeline is equipped with a (water) film over the entire circumference. In this way, the attachment of solid particles and deposits of salts formed are largely avoided.

According to the invention, a venturi scrubber is arranged in each of all the gas exits after leaving the cooling and quenching vessel, for crude gas fine cleaning.

The device according to the invention is preferable used in such a way that, directly on the slag-gas outlet from the gasification reactor in the upper part of a cooling and quenching vessel arranged underneath, a separate cylindrical flash quenching room is arranged in which pre-quenching takes place, and by means of further nozzle systems, the stream of gas directed upwards, formed with the secondary vortex and still charged with solid particles, the inside wall of the cooling and quenching vessel, the crude gas outlet stream from the cooling and quenching vessel and internal fittings in the cooling and quenching vessel serving as crude gas vent are sprayed with water.

The device according to the invention is preferably used for treating hot pressure gasification gases from fly stream gasifiers.

The invention also relates to a process for treating charged hot gas which preferably is the crude gas slag stream originating from a (fly stream) gasification reactor, quenching liquid being injected into the charged hot gas in a first step in a quantity of up to approximately 50 $m^3$, preferably 5 to 50 $m^3$ per 10,000 $m^3$ crude gas in the standard state, dry, and with a nozzle discharge rate of up to approximately 30 m/s, preferably 2 to 30 m/s, the droplet spectrum of the quenching liquid being adjusted to a range of approximately 3,000 μm, preferably 100-3,000 μm and, subsequently, quenching liquid being injected in a further step in a quantity of approximately 10 $m^3$, preferably 1 to 10 $m^3$ per 1000 $m^3$ crude gas in the standard state, dry, and with a nozzle discharge rate of up to approximately 30 m/s, preferably 1 to 10 m/s, the droplet spectrum of the quenching liquid issuing from the nozzles being adjusted to a range of approximately 500 μm, preferably 50-500 μm.

Advantageously, up to approximately 30 nozzles, in particular 1 to 30 nozzles per 10,000 $m^3$ crude gas in the standard state, dry (uncharged hot gas) are used, at least 4 individual nozzles being appropriately used.

Particularly preferably, the process according to the invention is used in the device according to the invention.

Figure 2:
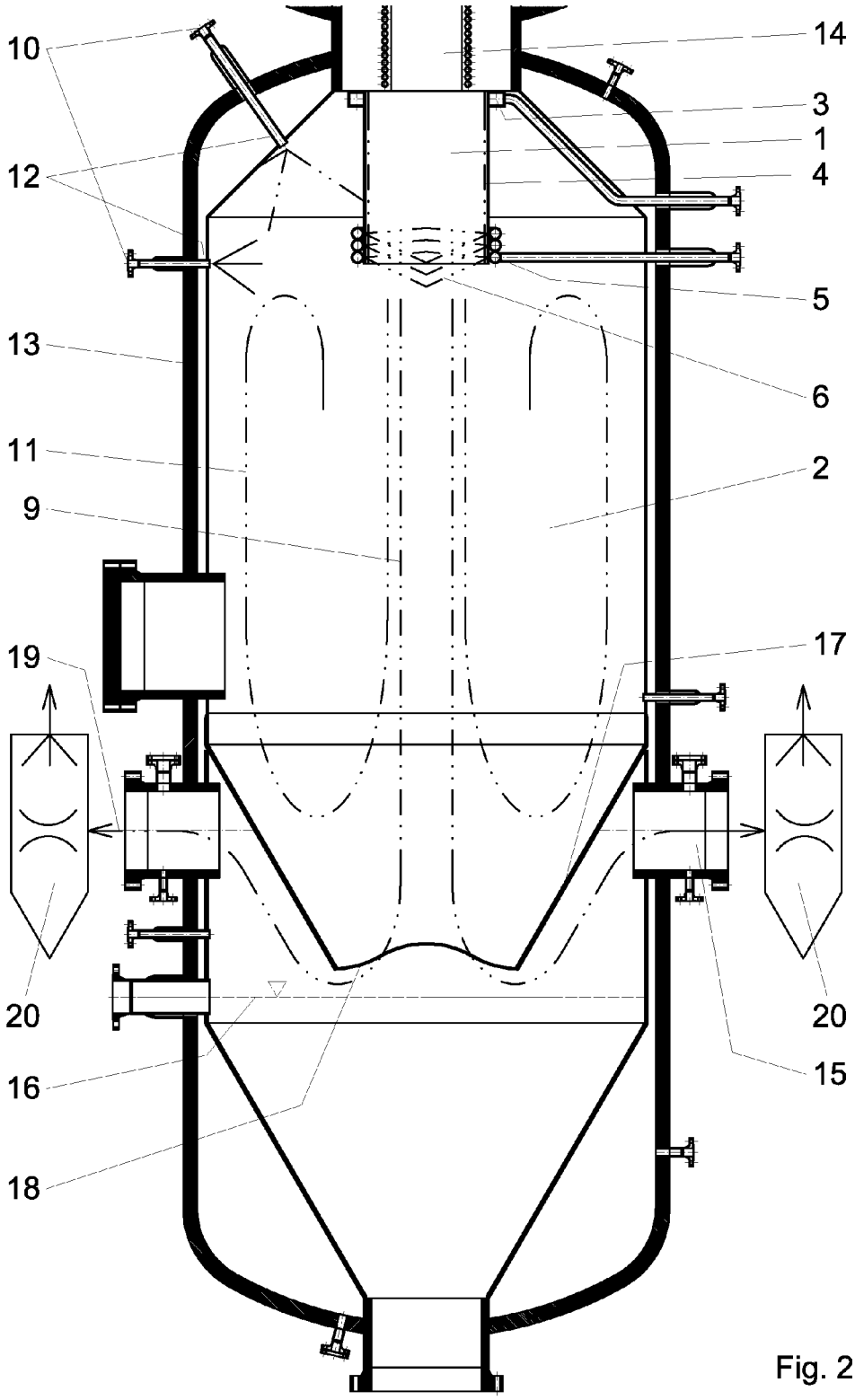

The invention is illustrated by the following embodiments by way of FIGS. 1 and 2, where FIG. 1: shows the device according to the invention in association with a central crude gas vent and FIG. 2: shows the device according to the invention in association with several crude gas exits arranged laterally.

The embodiment relates to the use of the invention in a coal dust pressure gasifier with integrated quenching system. Output of the gasifier is 80,000 $m^3$ in the standard state/h, dry.

The cooling and quenching vessel 13 arranged directly below the gasification reactor is divided into a flash quenching chamber 1 and a main quenching chamber 2. The gas inlet 14 (in this case: the slag drainage body of the gasifier) has a diameter of 600 mm and a height of 1000 mm. The inside of the cylindrical flash quenching chamber 1 with a diameter of 800 mm is loaded at the top via the water supply facility 3 with 40 $m^3$/h water via a water ring chamber such that a closed water film 4 draining downwards is formed on the inside of the flash quenching chamber. The actual quenching of the gas stream takes place in each case by means of 30 $m^3$/h via 3 nozzle rings 5 which are fitted with 8 individual nozzles each. The jacket of the flash quenching chamber has apertures corresponding to the position of the individual nozzles, in order to guarantee entry of the liquid streams 6 with a droplet size of 0.5 to 3 mm and a flow rate of 15 m/s into the crude gas stream.

The secondary vortex 11 produced by the arrangement of the gas outlet device 8 is sprayed with 60 $m^3$/h water by means of the 32 spray nozzles 12 arranged in the cupola of the main quenching vessel in such a way that, by adjusting the direction of spraying and the droplet size of 100 to 300 μm, an intense contact between the water droplets and the fine particles not yet separated off in the crude gas and complete wetting of the inside wall of the cooling and quenching vessel 2 takes place.

The discharge of the crude gas from the main quenching chamber takes place via the crude gas discharge pipe 7 arranged in the axis of the vessel, above which tube the conical gas outlet device 8 required for the separation of the solid/liquid particles from the crude gas is arranged. The quantity of water of 20 $m^3$/h required for wetting the top of the capture device is supplied via the nozzle system 9 with the water supply line 10 at the tip of the capture device.

The alternative solution according to FIG. 2 according to the invention is equipped in the lower vessel area with several gas exits 15 which are situated above the water level 16 and equipped with conical flow baffles 17 above the individual crude gas exit for separating off the solid/water particles. The lower end 18 of the individual baffle is designed geometrically in such a way that the streamlines of the gas stream have the same length from each point of the lower edge 18 of the baffle up to the middle of the crude gas escape 19 as a result of which a rotation symmetrical gas conduct is guaranteed in the main quenching chamber 2.

LIST OF REFERENCE NUMBERS

1 flash quenching chamber
2 main quenching chamber
3 water supply facility
4 water film
5 nozzle rings
6 liquid jets
7 crude gas discharge tube
8 gas outlet device
9 nozzle system
10 water supply line
11 secondary vortex
12 spray nozzles
13 cooling and quenching vessel
14 gas inlet
15 gas exits
16 water level
17 flow baffles
18 lower end 18 of the individual baffle
19 crude gas vent
20 venturi scrubber

The invention claimed is:

1. A device for the treatment of a charged hot gas comprising a cooling and/or quenching vessel having a gas inlet and a gas discharge, wherein:

a first quenching chamber and a second quenching chamber are formed in said cooling and/or quenching vessel, the first quenching chamber is arranged in the upper part of the cooling and/or quenching vessel in the area of the gas inlet and has a diameter which is approximately 1.05 to 5 times that of an inside diameter of the gas inlet and a length which is approximately 0.5 to 5 times that of the inside diameter of the gas inlet, one or more nozzle rings comprising nozzles are arranged in the lower area of the first quenching chamber which are designed in such a way that 1 to 30 nozzles are available per 10,000 $m^3$ of hot gas in the standard state, dry (i.s.dr.), and the nozzles are configured in such a way that a quenching liquid issues at a downward angle of −30° to an upward angle of 5° in a quantity of 5 to 50 $m^3$ per 10,000 $m^3$ of hot gas in the standard state, dry, with a nozzle discharge rate of 2 to 30 m/s and with a droplet spectrum of 100-3,000 μm.

2. The device according to claim 1, wherein a film producing device is allocated to the first quenching chamber for the production of a quenching liquid film on the inside wall of the first quenching chamber.

3. The device according to claim 1, wherein at least one additional nozzle ring is arranged behind and/or below the first quenching chamber, wherein the additional nozzle ring is configured to issue quenching liquid in a quantity of 1 to 10 $m^3$ per 1000 $m^3$ hot gas in the standard state, dry, and a nozzle discharge rate of 1 to 10 m/s and with a droplet spectrum in the range of 50-500 μm.

4. The device according to claim 1, the nozzle rings exhibiting at least 4 individual nozzles each.

5. The device according to claim 1, wherein a gas exit arranged essentially in the axis of the second quenching chamber is provided which is equipped with an essentially conical gas outlet device with a conus tip directed upwards.

6. The device according to claim 5, wherein the conus tip of the gas outlet device is equipped with a nozzle system for the formation of a film on the surface of the conus tip.

7. The device according to claim 6, wherein the conus tip of the gas outlet device is loadable from the inside towards the outside through at least one aperture with liquid.

8. The device according to claim 1, wherein a Venturi scrubber is allocated to all gas exits after leaving the cooling and quenching vessel.

9. The device according to claim 2, wherein at least one additional nozzle ring is arranged behind and/or below the first quenching chamber, wherein the additional nozzle ring is configured to issue quenching liquid in a quantity of 1 to 10 $m^3$ per 1000 $m^3$ hot gas in the standard state, dry, and a nozzle discharge rate of 1 to 10 m/s and with a droplet spectrum in the range of 50-500 μm.

10. The device according to claim 9, wherein a gas exit arranged essentially in the axis of the second quenching chamber is provided which is equipped with an essentially conical gas outlet device with a conus tip directed upwards.

11. The device according to claim 10, wherein the conus tip of the gas outlet device is equipped with a nozzle system for the formation of a film on the surface of the conus tip.

12. The device according to claim 11, wherein the gas discharge is equipped with a device which ensures charging of the gas discharge in the direction of flow with quenching liquid.

13. A device for the treatment of charged hot gas comprising a cooling and/or quenching vessel, the vessel comprising:

a) a gas inlet;

b) a first gas phase quenching chamber arranged in an upper part of the cooling and/or quenching vessel in the area of the gas inlet;

c) a second gas phase quenching chamber arranged vertically downward under the gas inlet and including the first quenching chamber concentrically in its upper part;

d) a gas discharge in a lower area of the cooling and/or quenching vessel; and, e) wherein one or several nozzle rings are arranged in a lower area of the first gas phase quenching chamber with a beam direction of the nozzles onto the axis of the charged hot gas stream.

14. The device according to claim 13, wherein the first gas phase quenching chamber has a diameter which is approximately 1.05 to 5 times that of an inside diameter of the gas inlet and a length which is approximately 0.5 to 5 times that of the inside diameter of the gas inlet.

15. The device according to claim 13, wherein 1 to 30 nozzles are available per 10,000 $m^3$ of hot gas in the standard state, dry (i.s.dr.).

16. The device according to claim 15, wherein the nozzles are configured in such a way that a quenching liquid issues at a downward angle of −30° to an upward angle of 5° in a quantity of 5 to 50 $m^3$ per 10,000 $m^3$ of hot gas in the standard state, dry, with a nozzle discharge rate of 2 to 30 m/s and with a droplet spectrum of 100-3,000 μm.

17. The device according to claim 13, wherein a film producing device is allocated to the first quenching chamber for the production of a quenching liquid film on the inside wall of the first quenching chamber.

18. The device according to claim 13, wherein at least one additional nozzle ring is arranged behind and/or below the first quenching chamber, wherein the additional nozzle ring is configured to issue quenching liquid in a quantity of 1 to 10 $m^3$ per 1000 $m^3$ hot gas in the standard state, dry, and a nozzle discharge rate of 1 to 10 m/s and with a droplet spectrum in the range of 50-500 μm.

19. The device according to claim 13, wherein the gas discharge is arranged essentially in the axis of the second quenching chamber and is equipped with an essentially conical gas outlet device with a conus tip directed upwards, wherein the gas discharge is equipped with a nozzle system for the formation of a film on the surface of the conus tip.

20. The device according to claim 13, wherein the gas discharge is equipped with a device which ensures charging of the crude gas discharge in the direction of flow with quenching liquid.

21. The device according to claim 13, wherein a Venturi scrubber is allocated to the gas discharge after the gas discharge leaves the cooling and quenching vessel.

* * * * *